US009150976B2

(12) United States Patent
Saito et al.

(10) Patent No.: US 9,150,976 B2
(45) Date of Patent: Oct. 6, 2015

(54) ELECTROLYTIC COPPER PLATING LIQUID AND THE ELECTROLYTIC COPPER PLATING METHOD

(71) Applicant: Rohm and Haas Electronic Materials LLC, Marlborough, MA (US)

(72) Inventors: Mutsuko Saito, Niigata (JP); Makoto Sakai, Niigata (JP); Yoko Mizuno, Niigata (JP); Toshiyuki Morinaga, Niigata (JP); Shinjiro Hayashi, Niigata (JP)

(73) Assignee: Rohm and Haas Electronic Materials LLC

( * ) Notice: Subject to any disclaimer, the term of this patent is extended or adjusted under 35 U.S.C. 154(b) by 66 days.

(21) Appl. No.: 14/043,826

(22) Filed: Oct. 1, 2013

(65) Prior Publication Data

US 2014/0097087 A1 Apr. 10, 2014

(30) Foreign Application Priority Data

Oct. 4, 2012 (JP) ..... 2012-222342

(51) Int. Cl.
*C25D 3/38* (2006.01)

(52) U.S. Cl.
CPC ..... *C25D 3/38* (2013.01)

(58) Field of Classification Search
CPC ..... C25D 3/38
USPC ..... 205/291, 296
See application file for complete search history.

(56) References Cited

U.S. PATENT DOCUMENTS 4,790,912 A * 12/1988 Holtzman et al. ..... 216/17
2010/0219081 A1* 9/2010 Isono et al. ..... 205/291

* cited by examiner

*Primary Examiner* — Edna Wong

(57) ABSTRACT

Copper electroplating liquid which does not use formaldehyde, which is harmful to the environment, and which exhibits excellent via filling ability is offered. The copper electroplating liquid of this invention includes the compound that has the structure of —X—S—Y— where X and Y are each an atom selected from the group of hydrogen atoms, carbon atoms, sulfur atoms, nitrogen atoms and oxygen atoms, and X and Y can be the same only when they are carbon atoms, and a specific urea derivative. When the copper electroplating liquid is used, deterioration of the appearance will not occur and a good filled via can be formed.

4 Claims, 5 Drawing Sheets

ELECTROLYTIC COPPER PLATING LIQUID AND THE ELECTROLYTIC COPPER PLATING METHOD

FIELD OF THE INVENTION

This invention relates to the electrolytic copper plating liquid that contains the compound that includes sulfur atoms and a specific urea derivative, and also the electrolytic plating method that uses the said electrolytic copper plating liquid.

BACKGROUND OF THE INVENTION

Recently, in the production of the base body of printed wiring boards that are used for electronic equipment such as personal computers, etc., the plating method that is called through hole plating or via fill plating, has been used. The speed of deposition of the plate film in the electrolytic copper plating is fast, 10 to 50 μm/hr, therefore, the application of this for through hole and via fill plating has been expected. However, in the case of depositing the copper on the entire inner surface of the via, in order to fill the inside of the via completely with copper with no remaining space, the deposition speed near the bottom surface of the via must be faster than the deposition speed at the opening part. If the speed of deposition near the bottom is the same as or slower than the speed of deposition at the opening end, the via might not be filled, or the opening might be closed before completion of the filling of the copper plating in the via, and empty spaces will remain inside, and neither of these cases is acceptable for practical use. Also, in the through hole plating, good covering strength in the through hole, which is called slowing power, is required.

Up to now, in order to promote the speed of deposition on near the bottom surface of via and the wall surface of the through hole, an electrolytic copper plating bath that includes a specific compound that contains sulfur has been used, and concerning the electrolysis conditions, generally direct current electrolysis that uses a soluble anode such as a sulfur-containing-copper anode, etc. was used. However in this method, although good via fill performance can be seen just after the bath is prepared, the electrolytic copper plating bath becomes unstable with the passing of time, and after a certain period of time, lumps are generated in the formation of the electrolytic copper plate layer, and the plate appearance becomes poor and the filling of the via becomes unstable, and these were the problems. Also, in through hole plating, the reliability for thermal impact and the slowing power used to be decreased.

In order to solve these problems, Kokai Patent No. 2002-249891 disclosed the electrolytic copper plating liquid which includes a specific compound that contains sulfur atoms, and a thiol reactive compound. As the thiol reactive compound, aliphatic, alicyclic, aromatic or hetero cyclic compound carboxylic acids, peroxo acids, aldehydes and ketones, and hydrogen peroxides are disclosed, and in the actual Examples, it described that formaldehyde can improve the filling ability. However, recently, the effects of formaldehyde on the environment and the human body have become a concern and also the ignition point of formaldehyde is low (66° C.), therefore, people have been searching for another compound which can improve the via fill ability and which can replace formaldehyde.

SUMMARY OF THE INVENTION

This invention was made considering the above mentioned situation, and the objective is to offer the electrolytic copper plating liquid which is the copper plating liquid that contains a specific compound that includes sulfur atoms and which does not use formaldehyde, and which does not cause deterioration of the appearance of the plate and also which is suitable for forming the via fill, and also to offer the electrolytic copper plating method that uses the said plating liquid.

The inventors investigated various compounds, and as the results, they discovered that the above mentioned problem can be solved when a specific urea derivative is used instead of formaldehyde, and this invention was made.

Namely, this invention relates to the electrolytic copper plating liquid that includes the compound that has an —X—S—Y— structure (in the formula, X and Y are each atoms that are selected from the group of hydrogen atoms, carbon atoms, sulfur atoms, nitrogen atoms and oxygen atoms, and X and Y can be the same only in the case of carbon atoms), and the N,N'-bis(hydroxy methyl)urea that can be indicated by the following chemical formula.

Chemical Formula 1

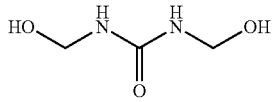

Also, this invention relates to the electrolytic copper plating method that uses the above mentioned electrolytic copper plating liquid.

As will be explained below, according to this invention, the electrolytic copper plating liquid that includes a sulfur-containing compound and N,N'-bis(hydroxy methyl)urea is used, therefore, the effect of the compound that has the "—X—S—⁻" structure which is the decomposed material of the sulfur-containing compound, is decreased, and by this, the plate appearance is not deteriorated, and the via fill ability can be maintained to be good.

DETAILED DESCRIPTION OF THE INVENTION

Figure 1:
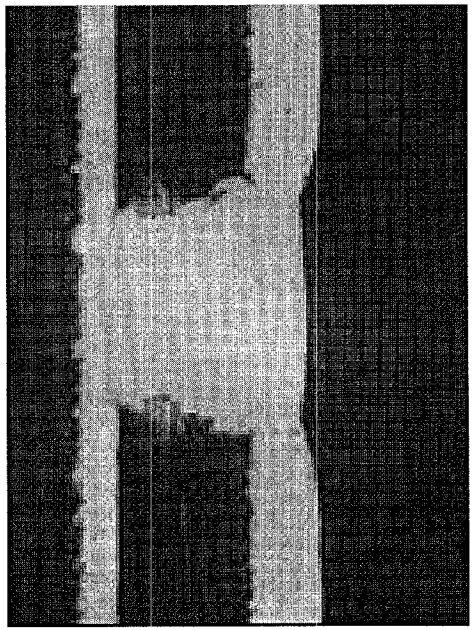
FIG. 1 shows the via fill in the case when the plating liquid of Example 1 was used, and it shows the cross section of the via after plating treatment.

Concerning the electrolytic copper plating liquid, any bath liquid can be used as long as copper can be electroplated. For instance, a copper sulfate plating liquid, a copper cyanide plating liquid, a copper pyro phosphate plating liquid, etc., can be listed, but it is not limited to these. Preferably, the copper electroplating liquid should be a copper sulfate plating liquid. Next, a copper sulfate plating liquid will be explained as the representative example of copper electroplating liquid, however, even in the case of other plating liquids, it should be possible for people in this field to easily determine the composition, components, etc., from the following description and the already known references, etc.

The copper electroplating liquid of this invention contains the compound that has the —X—S—Y— structure. Preferably, X and Y in the above mentioned compound structure are each atoms that are selected from the group of hydrogen atoms, carbon atoms, sulfur atoms, nitrogen atoms and oxygen atoms, and in this description, the above mentioned compounds are called sulfur-containing compounds for convenience. More preferably, X and Y should each be atoms that are selected from the group of hydrogen atoms, carbon atoms, nitrogen atoms and sulfur atoms, and even more preferably, X and Y should each be atoms that are selected from the group of hydrogen atoms, carbon atoms and sulfur atoms. Here, X and Y can only be the same in the case of carbon atoms. In the structural formula —X—S—Y—, S indicates a valence of 2, however, it does not mean that X and Y also have valences of 2, and it means that the X and Y atoms can bond with any other atom, depending on the valence. For instance, in the case when X is hydrogen, it has the structure of H—S—Y—.

Preferably, the sulfur-containing compound is the compound which has a sulfonic acid group or a group that is an alkali metal salt of sulfonic acid in the molecule. One or more sulfonic acid group or its alkali metal salt can exist in the said molecule. More preferably, the sulfur-containing compound should be a compound which has structure of —S—$CH_2O$—R—$SO_3M$- in the molecule, or a compound which has the structure of —S—R—$SO_3M$- in the molecule (in the formula, M is hydrogen or an alkali metal atom, and R is an alkylene group that contains 3 to 8 carbon atoms). More preferably, the sulfur-containing compounds should be compounds that have the following structures (S1) to (S8).

$$M\text{-}SO_3\text{—}(CH_2)_a\text{—}S\text{—}(CH_2)_b\text{—}SO_3\text{-}M; \quad (S1)$$

$$M\text{-}SO_3\text{—}(CH_2)_a\text{—}O\text{—}CH_2\text{—}S\text{—}CH_2\text{—}O\text{—}(CH_2)_b\text{—}SO_3\text{-}M; \quad (S2)$$

$$M\text{-}SO_3\text{—}(CH_2)_a\text{—}S\text{—}S\text{—}(CH_2)_b\text{—}SO_3\text{-}M; \quad (S3)$$

$$M\text{-}SO_3\text{—}(CH_2)_a\text{—}O\text{—}CH_2\text{—}S\text{—}S\text{—}CH_2\text{—}O\text{—}(CH_2)_b\text{—}SO_3\text{-}M; \quad (S4)$$

$$M\text{-}SO_3\text{—}(CH_2)_a\text{—}S\text{—}C(=S)\text{—}S\text{—}(CH_2)_b\text{—}SO_3\text{-}M; \quad (S5)$$

$$M\text{-}SO_3\text{—}(CH_2)_a\text{—}O\text{—}CH_2\text{—}S\text{—}C(=S)\text{—}S\text{—}CH_2\text{—}O\text{—}(CH_2)_b\text{—}SO_3\text{-}M; \quad (S6)$$

$$A\text{-}S\text{—}(CH_2)_a\text{—}SO_3\text{-}M; \text{ or} \quad (S7)$$

$$A\text{-}S\text{—}CH_2\text{—}O\text{—}(CH_2)_a\text{—}SO_3\text{-}M \quad (S8)$$

In the above mentioned formulas (S1) to (S8), a and b are each integers of 3 to 8. M is a hydrogen atom or an alkali metal element. A can be a hydrogen atom, an alkyl group with 1~10 carbon atoms, an aryl group, a linear or cyclic amine compound that is formed with 1 to 6 nitrogen atoms, 1 to 20 carbon atoms, and more than one hydrogen atom, or a hetero cyclic compound which is formed with 1 to 2 sulfur atoms, 1 to 6 nitrogen atoms, 1 to 20 carbon atoms and more than one hydrogen atom.

The sulfur-containing compound is generally used as a luster agent (called a brightener too), however, the case of using it for other purposes is also included in the scope of this invention. Concerning the sulfur-containing compound, one may be used alone or 2 or more may be mixed to be used too.

In the case when the sulfur-containing compound is a brightener, the brightener can be used in the range of, for instance, 0.1 to 100 mg/L, preferably 0.5 to 10 mg/L, in the plating liquid. When the concentration of sulfur-containing compound in the plating liquid is less than 0.1 mg/L, sometimes, the effect of assisting the growth of the copper plate film cannot be obtained. On the other hand, even if the concentration exceeds 100 mg/L, the improvement of the effect that matches that increase cannot be obtained, therefore, an amount exceeding 100 mg/L is not preferred for economical reasons. In the case when the sulfur-containing compound is used for a purpose other than that of a brightener, the suitable range for its usage can be appropriately determined by people in this field.

Previously, the inventors discovered that an increase in the —X—$S^-$ or —Y—$S^-$ compounds which are the decomposed material that is formed when the single bond of the above mentioned sulfur-containing compound —X—S—Y— is cut, causes deterioration of the via fill ability and the plate appearance in the copper electroplating. Here, in the above mentioned sulfur-containing compound, X and Y can be exchanged, for instance, in the case of the above mentioned brightener (S1) M-$SO_3$—$(CH_2)_a$—S—$(CH_2)_b$—$SO_3$-M, it is considered that M-$SO_3$—$(CH_2)_a$—$S^-$ or $^-S$—$(CH_2)_b$—$SO_3$-M will be formed as the decomposed material, but either of these may be considered to be —X—$S^-$ or —Y—$S^-$. Therefore, in this description, the decomposed material of the sulfur-containing compound is indicated as "—X—$S^-$" for convenience.

Although not restricted by theory, concerning the main mechanism of forming the compound that has a "—X—$S^-$" structure in the copper electroplating liquid, for instance, we believe that by using a soluble anode such as phosphorus-containing copper, the soluble anode and the above mentioned sulfur-containing compound react with each other during the time period when the electrolysis is stopped, and the single bond of S—X or S—Y in the sulfur-containing compound is cut, and the compound that has the structure of "—X—$S^-$" is formed. Also, we believe that in the copper electroplating treatment, in the cathode, the above mentioned sulfur-containing compound receives an electron, and the single bond of S—X or S—Y is cut, and the compound that has the structure of "—X—$S^-$" is formed. At the anode, we believe that electrons are released from the soluble anode when the Cu becomes $Cu^{2+}$, and receiving these electrons, the above mentioned sulfur-containing compound attains the structure of "—X—$S^-$".

Also, although not restricted by theory, concerning the action mechanism where the compound which has the "—X—$S^-$" structure adversely affects the copper electroplating, we believe that the said compound ionicly bonds with the metal ions such as $Cu^+$ or $Cu^{2+}$, and due to the existence of this bonded material, the metal that is deposited forms lumps, and the metal layer that exhibits inferior attachability and heat resistance, etc., is formed, and this also results in the poor appearance of the plate such as brightness failure, etc. Also we think that in the formation of the via fill, the bonded material of the above mentioned decomposed material and the metal ions, makes the metal depositing speed near the bottom of the via to be the same as or slower than the depositing speed at the via opening part, and by this, filling of the via becomes insufficient, or depending on the shape of the via, the via is filled while empty spaces remain inside.

The concentration of the compound that has the —X—$S^-$ structure can be greatly reduced by conducting the copper electroplating using the plating liquid of this invention. The concentration of the compound that has an —X—$S^-$ structure should be preferably maintained at 2.0 μmol/L or less from the view point of not making the plate appearance to be non-lusterous, and from the view point of making a lusterous appearance, it should be maintained at 1.0 μmol/L or less, and 0.5 μmol/L is more preferred. Also, from the view point of improving the via fill ability, the concentration of the compound that has a —X—S⁻ structure should be preferably maintained at 0.15 μmol/L or less, and 0.1 μmol/L or less is more preferred.

The copper electroplating liquid of this invention includes N,N'-bis(hydroxy methyl)urea that can be indicated by the following formula.

Chemical Formula 2

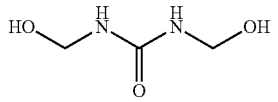

The inventors investigated various compounds such as the above mentioned compounds and compounds similar to this, namely, other urea derivatives, thiourea, etc., and as a result they discovered that only this compound uniquely reduces the effect of the compound that has the structure of "—X—S⁻", and that it does not cause the deterioration of the plate appearance, and also that it has the effect of maintaining the good via fill ability.

The amount of the N,N'-bis(hydroxy methyl)urea to be added into the copper electroplating liquid can be appropriately selected depending on the objective, such as the improvement of the plate appearance, improvement of the via fill ability, and also depending on the amount and the type of the sulfur-containing compound that is added into the copper electroplating liquid, and also depending on the copper electroplating treatment conditions, such as the type of electrode, the load method of the current, etc. the N,N'-bis(hydroxy methyl)urea should be included at a concentration of 1 to 100,000 mg/L, preferably 10 to 1,000 mg/L, more preferably 50 to 1,000 mg/L, in the copper electroplating liquid.

The N,N'-bis(hydroxy methyl)urea used in this invention should be added to become 10 times or more of the molar amount of the compound that has the "—X—S⁻" structure that is formed in the plating liquid, preferably 100 times or more, more preferably 500 times or more and even more preferably 750 times or more. The upper limit of the mol ratio of the N,N'-bis(hydroxy methyl)urea to the compound that has the "—X—S⁻" structure that is formed, is not particularly limited, but normally, it should be 1,000,000× or less, preferably 100,000× or less.

In this invention, the N,N'-bis(hydroxy methyl)urea can be added into the copper electroplating liquid at any time. For instance, it can be added at the time of preparing the copper electroplating bath, or during the copper electroplating treatment, or after the copper electroplating treatment. The N,N'-bis(hydroxy methyl)urea may be added while monitoring the amount of the compound that has the "—X—S⁻" structure in the plating liquid and it can be added when the amount of the said compound exceeds the prescribed amount. It is also possible to add it when the desired plating performance cannot be obtained, and this can be used as the indicator and it can be added at that time too. Also, the N,N'-bis(hydroxy methyl) urea may be added "as is", or it can be added after it is dissolved in water, or it can be added after it is mixed with other additives too.

Except for the compound that has the "—X—S⁻" structure and the N,N'-bis(hydroxy methyl)urea, the basic composition of the copper electroplating liquid of this invention is not particularly limited as long as it can be used for the normal copper electroplating, and as long as the objectives of this invention can be achieved, changing of the components of the basic composition, changing of the concentrations or adding additives, etc., can be done. For instance, in the case of copper sulfate plating, the copper sulfate plating liquid may be an aqueous solution that includes sulfuric acid, copper sulfate and a water soluble chlorine compound as the basic composition, and components other than these may also be used without limitation as long as it is used for the already known copper sulfate plating.

In the case of a plating bath for general through hole plating, the sulfuric acid concentration in the copper sulfate plating liquid should be normally 10 to 400 g/L, preferably 50 to 100 g/L. Also, in the bath for the normal via fill plating, normally the concentration should be 10 to 400 g/L, and preferably 150 to 250 g/L. For instance, if the sulfuric acid concentration is less than 10 g/L, the conductivity of the plating bath decreases, therefore, sometimes it becomes difficult to pass electricity in the plating bath. Also, when it exceeds 400 g/L, it inhibits the dissolution of the copper sulfate in the plating bath, and the sometimes the copper sulfate settles out.

The water soluble chlorine compound included in the copper sulfate plating liquid is not particularly limited as long as it is used for the already known copper sulfate plating liquids. As such water soluble chlorine compound, for instance, hydrochloric acid, sodium chloride, potassium chloride, ammonium chloride, etc., can be listed, but it is not limited to these. The water soluble chlorine compound may be used alone or two or more may be mixed and used too. The concentration of the said water soluble chlorine compound that is included in the copper sulfate plating liquid used in this invention should be normally 10 to 200 mg/L, preferably 30 to 80 mg/L as the chlorine ion concentration. If the chlorine ion concentration is less than 10 mg/L, sometimes, the brightener, surfactant, etc., do not work correctly. Also, when it exceeds 200 mg/L, the generation of chlorine gas from the anode increases.

The copper electroplating liquid of this invention may include a leveler (this can also be called a smoothing agent too) too. Leveler is the general name of the compound which is selectively adsorbed on the plating surface during plating and which restricts the speed of deposition. The leveler may be any already known surfactant that is normally used as an additive for electroplating liquids too. In the case when a surfactant is used as a leveler, preferably the compound that has the following structure of (A1) to (A5) can be listed, however, it is not limited to these.

$$HO—(CH_2—CH_2—O)_a—H \quad (A1)$$

(In the formula, a is an integer of 5 to 500)

$$HO—(CH_2—CH(CH_3)—O)_a—H \quad (A2)$$

(In the formula, a is an integer of 5 to 200)

$$HO—(CH_2—CH_2—O)_a—(CH_2—CH(CH_3)—O)_b—(CH_2—CH_2—O)_c—H \quad (A3)$$

(In the formula, a and c are integers and a+c=5 to 250, b is an integer of 1 to 100)

$$H—(NH_2CH_2CH_2)_n—H \quad (A4)$$

(In the formula, n=5~500)

or

Chemical Formula 3

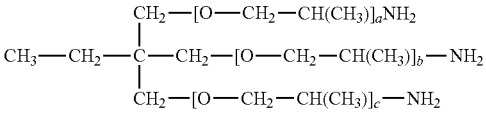

(in this formula, a, b, c are each integers of 6 to 200)

The leveler used in this invention can be used alone or two or more may be combined for use. The leveler can be used in the range of 0.05 to 10 g/L, preferably 0.1 to 5 g/L in the plating liquid. If the concentration of leveler in the plating liquid is less than 0.05 g/L, the wetting effect becomes insufficient and the plate film experiences many pin holes, and it sometimes becomes difficult to deposit normal plate film. And even if it exceeds 10 g/L, an increase in the effect matching that increase cannot be obtained, therefore, it is not preferred from an economical viewpoint.

The copper electroplating liquid of this invention can include a carrier too. Normally, a surfactant is used as the carrier, and during the plating, it is adsorbed on the entire plating surface and it has the effect of restricting the speed of deposition.

To be specific, poly ethylene glycol (PEG), poly oxy propylene glycol; a block co-polymer or a random co-polymer of poly ethylene glycol and poly propylene glycol, etc., can be listed, however, it is not limited to these.

The carrier used in this invention can be used alone or in combinations of two or more. The carrier should be used in the range of 0.05 to 10 g/L, preferably 0.05 to 2 g/L in the plating liquid.

The base body for which the copper electroplating method of this invention can be used, can be made of any material and have any shape as long as it can withstand the conditions of the copper electroplating method and also be such that a metal layer can be formed by plating. As such material, resins, ceramics, metals, etc., can be listed, but it is not limited to these. Concerning examples of the base body, printed wiring boards can be listed as the base bodies made out of resin, and wafers for semiconductors can be listed as the base bodies made out of ceramic, but it is not limited to these. Also, as the metal, for instance, silicon, etc, can be listed, and the silicon wafer can be listed as the base body made out of a metal, but it is not limited to this. The copper electroplating method of this invention is especially good for filling the via hole, therefore, the base body which has through holes, via holes, etc., is especially preferred as the base body on which this invention is applied, and the more preferred base bodies are printed wiring boards or wafers that have though holes and/or via holes.

As the resins that can be used for the base body, for instance, poly ethylene resins such as high density poly ethylene, mid density poly ethylene, branched low density poly ethylene, linear low density poly ethylene, super high molecular weight poly ethylene, etc.; poly propylene resins; poly olefin resins such as poly butadiene, poly butene resin, poly butylene resin, poly styrene resin, etc.; halogen-containing resins such as poly vinyl chloride resin, poly vinylidene chloride resin, poly vinylidene chloride-vinyl chloride co-polymer resin, chlorinated poly ethylene, chlorinated poly propylene, tetra fluoro ethylene, etc.; AS resins; ABS resins; MBS resins; poly vinyl alcohol resins; poly acrylic acid ester resins such as poly methyl acrylate, etc.; poly methacrylic acid ester resins such as poly methyl methacrylate, etc.; methyl methacrylate-styrene co-polymer resin; maleic anhydride-styrene co-polymer resin; poly vinyl acetate resin; cellulose resins such as cellulose propionate resin, cellulose acetate resin, etc.; epoxy resins; poly imide resins; poly amide resins such as nylon, etc.; poly amide imide resins; poly allylate resins; poly ether imide resins; poly ether ether ketone resins; poly ethylene oxide resins; various poly ester resins such as PET resin, etc.; poly carbonate resins; poly sulfone resins; poly vinyl ether resins; poly vinyl butylal resin; poly phenylene ether resins such as poly phenylene oxide, etc.; poly phenylene sulfide resin; poly ethylene terephthalate resin; poly methyl pentene resin; poly acetal resins; vinyl chloride-vinyl acetate-co-polymers; ethylene-vinyl acetate co-polymers; ethylene-vinyl chloride co-polymers, etc and thermoplastic resins such as the co-polymers of these, and blends, etc., epoxy resin; xylene resin; guanamine resin; diallyl phthalate resin; vinyl ester resin; phenol resin; unsaturated poly ester resin; furan resin; poly imide resin; poly urethane resin; maleic acid resin; melamine resin; thermosetting resins such as urea resin, etc, and the mixtures of these can be listed, however, it is not limited to these. As the preferred resin, epoxy resin, poly imide resin, vinyl resin, phenol resin, nylon resin, poly phenylene ether resin, poly propylene resin, fluorine type resins, ABS resin, etc., can be listed. More preferably, epoxy resin, poly imide resin, poly phenylene ether resin, fluorine type resins, ABS resin, etc, can be listed, and even more preferred are epoxy resin and poly imide resin. The resin base body can be made out of a single resin, or from the more than one resin. Further, it may be a composite material where the resin is coated or laminated on a base body made out of another material. The resin base bodies that can be used in this invention are not limited to resin formed materials, and they may be the composite material where a reinforcing material such as glass fiber strengthening material, etc., is applied between resin layers too, or the one where a resin film is formed on the base body made out of various materials such as ceramic, glass, a metal such as silicone, etc., too.

As the ceramic materials that can be used as the base body material, oxide type ceramics such as alumina ($Al_2O_3$), steatite ($MgO.SiO_2$), forsterite ($2MgO.SiO_2$), mullite ($2Al_2O_3.2SiO_2$), magnesia (MgO), spinel ($MgO.Al_2O_3$), beryllia (BeO), and non-oxide type ceramic materials such as aluminum nitride, silicon carbide, etc., and low temperature baked ceramics including glass ceramics can be listed, but it is not limited to these.

Concerning the base body offered for the copper electroplating method of this invention, the part that is going to be plated should be metalized prior to the copper electroplating. For example, in the case of filling the via with metallic copper by copper electroplating using the method of this invention, first, the inner surface of the via is metalized. This metalizing can be done using any already known metalizing method, and as the metalizing method, for instance, electroless copper plating, direct plating method, conductive fine particle adsorbing treatment, the gas phase plating method, etc., can be listed, but it is not limited to these.

In the copper electroplating method of this invention, the plating temperature (liquid temperature) can be appropriately set depending on the type of the plating bath, but normally it should be 10 to 40° C., and preferably it should be 20 to 30° C. In the case when the plating temperature is lower than 10° C., the conductivity of the plating liquid becomes low, therefore, the current density during the electrolysis cannot be made high, and the growth rate of the plate film becomes slow, and the productivity decreases. Also, when the plating temperature is higher than 40° C., the brightener sometimes decomposes. In the copper electroplating method of this invention, any type of current, for instance direct current, PPR (Pulse Periodic Reverse) current, etc., can be used. The current density at the anode that is applied can be appropriately set depending on the type of the plating bath, but normally, it should be 0.1 to 10 $A/dm^2$, and preferably it should be 1 to 3 $A/dm^2$. If it is less than 0.1 $A/dm^2$, the anode area becomes too large and it is un-economical, and if it is larger than 10 $A/dm^2$, due to the oxygen generated from the anode during the electrolysis, the oxidization decomposition of the brightener component increases.

In the copper electroplating method of this invention, any type of electrode such as a soluble anode, an insoluble anode, etc., can be used. As a soluble anode, the phosphorus-containing copper anode can be listed, and as an insoluble anode, the anode of which the material is platinum coated titanium, platinum, graphite, ferrite, titanium where lead dioxide and a platinum family element oxide is coated, stainless steel, etc., can be listed, but it is not limited to these. In the plating method of this invention, it is preferred to increase the dissolved oxygen concentration in the plating liquid by passing air or oxygen through the plating liquid. Although we are not bound to the theory, we think that the dissolved oxygen in the plating liquid functions as an oxidizing agent, and it decreases the content of the compound that has the structure of "—X—$S^-$" in the said plating liquid. As the method to increase the concentration of dissolved oxygen in the plating liquid, the bubbling of air or oxygen in the plating liquid is preferred, and the said bubbling may be in the form of stirring the plating liquid or it does not need to be by stirring either. Also, the bubbling to increase the dissolved oxygen concentration in the plating liquid can be done during the electroplating treatment or it can be done when the plating treatment is stopped. In the plating method of this invention, mixing does not cause any problems, and in order to uniformly supply the copper ions and additives onto the surface of the material to be plated, it is preferred to mix it. Concerning the mixing method, air mixing or jet mixing can be used. From the view point of increasing the dissolved oxygen in the plating liquid, mixing with air is preferred. Also, in the case of mixing by jet, air mixing can be co-used too. Further, filtration or circulating filtration, can be done too, and circulating filtration with a filter is preferred. By this, the temperature of the plating liquid can be made uniform and also the junk or settled material in the plating liquid can be removed.

By the copper electroplating method of this invention, the composite material which has a copper layer on the base body can be obtained. When the copper electroplating is conducted using the copper electroplating liquid of this invention, the copper layer of the composite material that is obtained does not form lumps, and in the case of filling the via, a via fill without empty spaces can be achieved. Next, this invention will be explained in detail referring to actual examples, but the range of this invention is not limited by the said examples.

EXAMPLE 1

The plating liquid of this invention was prepared by adding each compound in the following concentrations:
copper sulfate 5 hydrate 200 g/L,
sulfuric acid 100 g/L.
1N-hydrochloric acid 7.0 mL/L (50 mg/L as chlorine),
bis(3-sulfo propyl)di-sulfide soda (SPS, brightener) 2 mg/L,
nitrogen-containing surfactant 2 g/L (leveler),
poly ethylene glycol 1 g/L (carrier)
and N,N'-bis(hydroxy methyl)urea 500 mg/L.

For the above mentioned plating liquid, 3-mercapto-1-propane sulfonic acid sodium salt (MPS, made by Tokyo Kasei Kogyo K.K.) was added to make a concentration of 100 μg/L, and the simulated deteriorated plating liquid was prepared. For the simulated deteriorated plating liquid, the Hull cell test and the via fill test were conducted, and the performance of the plating liquid was evaluated.

1. Hull Cell Test

Using the above mentioned simulated deteriorated plating bath, the phosphorus-containing copper anode for Hull cell use, and the Hull cell copper sheet cathode were submerged, and 2 A (ampere) of current was passed between the anode and the cathode for 2 minutes while it was stirred at a speed of 5 to 6 L/min by air mixing at a bath temperature of 22° C., and thus, the Hull cell test was conducted. Over the area from the left edge (high current density side) of the Hull cell panel to the right (low current density side), the appearance was checked, and the existence of "burns", "dull deposits" and "brightness" were evaluated. When the entire surface was "bright" it received a passing grade, and when "burnt" or "dull" spots existed, or in the case when an abnormal deposit was seen, it was evaluated with a non-passing grade.

2. Via Filling Ability Evaluation Test

For the above mentioned simulated deteriorated plating bath, the via filling ability was evaluated. As the base body to be plated, an evaluation base body (made by the CMK Co.) which had via fills (average diameter of 100 μm, depth of 60 μm) was used and the via fill plating was conducted according to the following process. After plating, the via was cut perpendicular to the surface of the base body, and the cut surface was observed with a metallographic microscope (GX51/OLYMPUS made). Here, concerning the evaluation of the via fill performance, the case when the plate deposit on the via appeared to the level of the base body surface of the opening of the via or higher, was considered to have a passing grade. The case when the deposit on the via did not fill to the above mentioned height was considered to have a non-passing grade.

3. Plating Process

The base body was copper electroplated by the following procedure.

Electroless plating (CUPOSIT™ 253 solution available from Rohm and Haas Electronic Material K.K.) plating conditions 35° C. for 20 minutes Acid washing (ACID CLEANER™ 1022-B solution: 10% available from Rohm and Haas Electronic Material Co., 40° C./3 minutes Water washing at 30-40° C. for 1 minute Water washing (Room temperature, 1 minute)

Copper electroplating (each composition, 22° C., current density: 2 A/dm, 45 minutes)

Water washing (room temperature, 1 minute)

Anti tarnish agent (ANTITARNISH™ 7130 solution available from Rohm and Haas Electronic Material Co., 10%, room temperature, for 30 seconds Water washing (room temperature, for 30 seconds)

Drying (dryer drying; 60° C., 30 seconds)

EXAMPLE 2

This was done the same as in Example 1 except that N,N'-bis(hydroxy methyl)urea was used at 100 mg/L.

Comparison 2-7

These were done the same as in Example 1 except that each compound indicated in Table 1 was used at 500 mg/L, instead of N,N'-bis(hydroxy methyl)urea.

TABLE 1

| | Type of additive | Amount added (mg/L) | Appearance | Via fill | Total evaluation |
|---|---|---|---|---|---|
| Example 1 | N,N'-bis (hydroxy methyl) urea | 500 | Good | Good | Pass |
| Example 2 | N,N'-bis (hydroxy methyl) urea | 100 | Good | Good | Pass |
| Comparison 1 | — | 0 | Good | Not good | Non-pass |
| Comparison 2 | Urea | 500 | Good | Not good | Non-pass |
| Comparison 3 | Hydroxy urea | | Good | Not good | Non-pass |
| Comparison 4 | (hydroxy methyl) urea | 500 | Good | Not good | Non-pass |
| Comparison 5 | N,N'-bis (hydroxy ethyl) urea | 500 | Good | Not good | Non-pass |
| Comparison 6 | 4,5-di-hydroxy-1,3-bis (hydroxy methyl) imidazolidine-2-on | 500 | Good | Not good | Non-pass |
| Comparison 7 | Thiourea | 500 | Not bright, ups and downs occurred due to abnormal deposition | Good | Non-pass |

Figure 2:
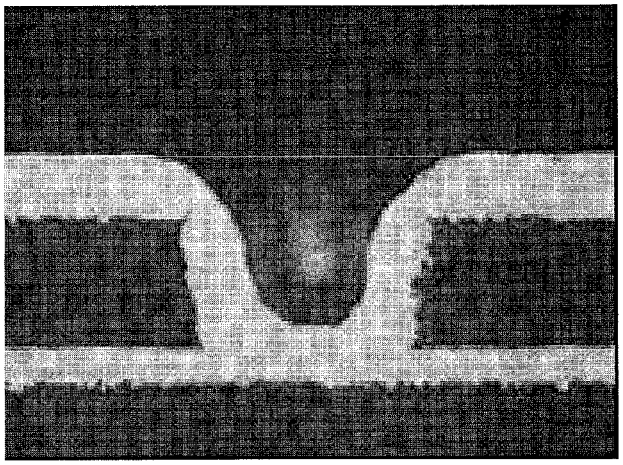
FIG. 2 shows the via fill in the case when the plating liquid of Comparison 1 was used, and it shows the cross section of the via after plating treatment.
Figure 3:
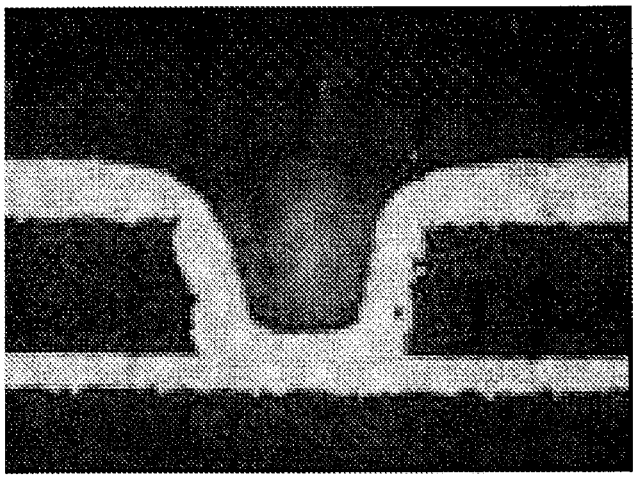
FIG. 3 shows the via fill in the case when the plating liquid of Comparison 2 was used, and it shows the cross section of the via after plating treatment.
Figure 4:
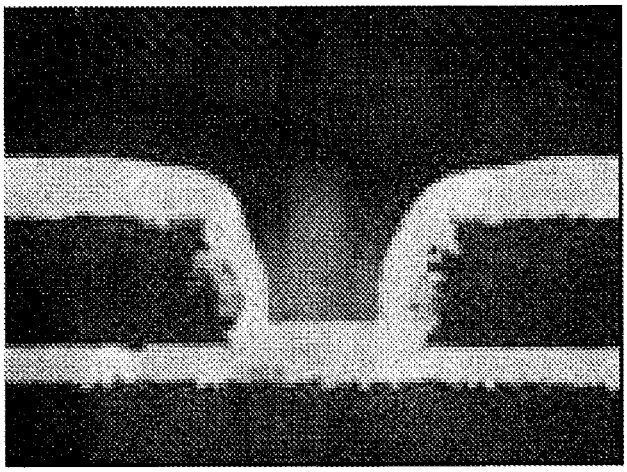
FIG. 4 shows the via fill in the case when the plating liquid of Comparison 4 was used, and it shows the cross section of the via after plating treatment.
Figure 5:
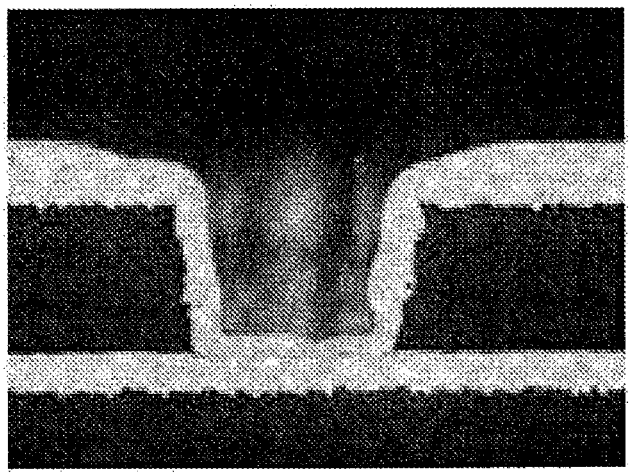
FIG. 5 shows the via fill in the case when the plating liquid of Comparison 5 was used, and it shows the cross section of the via after plating treatment.

A microscopic photo of when the via fill test was conducted in Example 1 is shown in FIG. 1. Also, FIG. 2 shows the microscopic photo of when the via fill test was conducted for Comparison 1. FIG. 3 is the microscopic photo of when the via fill test was conducted for Comparison 2. FIG. 4 is the microscopic photo of when the via fill test was conducted for Comparison 4, and FIG. 5 is the microscopic photo of when the via fill test was conducted for Comparison 5.

Structural Formula of the Compound that was Used in Comparison 2:

Chemical Formula 4

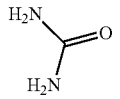

Structural Formula of the Compound that was Used in Comparison 3:

Chemical Formula 5

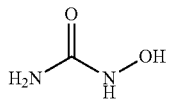

Structural Formula of the Compound that was Used in Comparison 4:

Chemical Formula 6

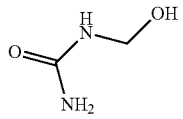

Structural Formula of the Compound that was Used in Comparison 5:

Chemical Formula 7

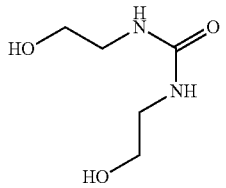

Structural Formula of the Compound that was Used in Comparison 6:

Chemical Formula 8

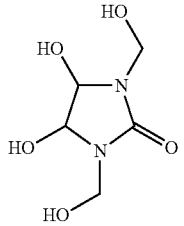

Structural Formula of the Compound that was Used in Comparison 7:

Chemical Formula 9

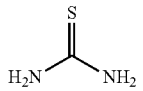

What is claimed is:

1. A copper electroplating liquid comprising a source of copper ions chosen from copper sulfate, copper cyanide or copper pyrophosphate; N,N'-bis(hydroxyl methyl)urea; and compounds selected from the group consisting of:

$$M\text{-}SO_3\text{—}(CH_2)_a\text{—}S\text{—}(CH_2)_b\text{—}SO_3\text{-}M; \quad (1)$$

$$M\text{-}SO_3\text{—}(CH_2)_a\text{—}O\text{—}CH_2\text{—}S\text{—}CH_2\text{—}O\text{—}(CH_2)_b\text{—}SO_3\text{-}M; \quad (2)$$

$$M\text{-}SO_3\text{—}(CH_2)_a\text{—}S\text{—}S\text{—}(CH_2)_b\text{—}SO_3\text{-}M; \quad (3)$$

$$M\text{-}SO_3\text{—}(CH_2)_a\text{—}O\text{—}CH_2\text{—}S\text{—}S\text{—}CH_2\text{—}O\text{—}(CH_2)_b\text{—}SO_3\text{-}M; \quad (4)$$

$$M\text{-}SO_3\text{—}(CH_2)_a\text{—}S\text{—}C(=S)\text{—}S\text{—}(CH_2)_b\text{—}SO_3\text{-}M; \text{ and} \quad (5)$$

$$M\text{-}SO_3\text{—}(CH_2)_a\text{—}O\text{—}CH_2\text{—}S\text{—}C(=S)\text{—}S\text{—}CH_2\text{—}O\text{—}(CH_2)_b\text{—}SO_3\text{-}M, \quad (6)$$

wherein a and b in compounds (1)-(6) are integers from 3 to 8, M is hydrogen or an alkali metal element.

2. The copper electroplating liquid of claim 1, further comprising a leveler and a carrier.

3. The copper electroplating liquid of claim 1, wherein the copper electroplating liquid is free of formaldehyde.

4. A method of electroplating copper comprising:

a) providing a copper electroplating liquid comprising a source of copper ions chosen from copper sulfate, copper cyanide or copper pyrophosphate; N,N'-bis(hydroxyl methyl)urea; and compounds selected from the group consisting of:

$$M\text{-}SO_3\text{—}(CH_2)_a\text{—}S\text{—}(CH_2)_b\text{—}SO_3\text{-}M; \quad (1)$$

$$M\text{-}SO_3\text{—}(CH_2)_a\text{—}O\text{—}CH_2\text{—}S\text{—}CH_2\text{—}O\text{—}(CH_2)_b\text{—}SO_3\text{-}M; \quad (2)$$

$$M\text{-}SO_3\text{—}(CH_2)_a\text{—}S\text{—}S\text{—}(CH_2)_b\text{—}SO_3\text{-}M; \quad (3)$$

$$M\text{-}SO_3\text{—}(CH_2)_a\text{—}O\text{—}CH_2\text{—}S\text{—}S\text{—}CH_2\text{—}O\text{—}(CH_2)_b\text{—}SO_3\text{-}M; \quad (4)$$

$$M\text{-}SO_3\text{—}(CH_2)_a\text{—}S\text{—}C(=S)\text{—}S\text{—}(CH_2)_b\text{—}SO_3\text{-}M; \text{ and} \quad (5)$$

$$M\text{-}SO_3\text{—}(CH_2)_a\text{—}O\text{—}CH_2\text{—}S\text{—}C(=S)\text{—}S\text{—}CH_2\text{—}O\text{—}(CH_2)_b\text{—}SO_3\text{-}M; \quad (6)$$

wherein a and b in compounds (1)-(6) are integers from 3 to 8, M is hydrogen or an alkali metal element;

b) providing a base body;

c) immersing the base body in the copper electroplating liquid; and d) electroplating copper on the base body.

* * * * *